US006071010A

United States Patent [19]

Chan

[11] Patent Number: 6,071,010

[45] Date of Patent: Jun. 6, 2000

[54] CARRYING BAG

[76] Inventor: Beatrice Chan, A3, Gee Luen Chang Industrial Building, 11 Yuk Yat Street, Tokwawan, Kowloon, The Hong Kong Special Administrative Region of the People's Republic of China

[21] Appl. No.: 09/212,480

[22] Filed: Dec. 16, 1998

[51] Int. Cl.[7] ..... B65D 30/10

[52] U.S. Cl. ..... 383/2; 383/4; 383/6

[58] Field of Search ..... 383/2, 4, 6, 17, 383/38, 119; 190/103, 107

[56] References Cited

U.S. PATENT DOCUMENTS

| | | | |
|---|---|---|---|
| 584,870 | 6/1897 | Giugliano | 190/107 X |
| 600,889 | 3/1898 | Reitzenbaum | 383/2 X |
| 1,604,658 | 10/1926 | Post | 383/2 |
| 1,719,455 | 7/1929 | Steckler | 383/2 |
| 1,730,603 | 10/1929 | Carlson | 383/2 |
| 2,466,208 | 4/1949 | Chanslor et al. | 383/4 X |
| 4,148,347 | 4/1979 | Seaman | 383/2 |
| 4,180,111 | 12/1979 | Davis | 383/2 |

FOREIGN PATENT DOCUMENTS

| | | | |
|---|---|---|---|
| 1066709 | 6/1954 | France | 383/2 |

*Primary Examiner*—Jes F. Pascua
*Attorney, Agent, or Firm*—Leydig, Voit & Mayer

[57] ABSTRACT

A carrying bag includes a flexible body having a top opening and left and right sides and co-operable fasteners along peripheries of the left and right sides, respectively. The left and right sides are foldable towards each other for transforming the bag into a narrower condition having a correspondingly smaller top opening, with the fasteners engaging, either directly with each other or indirectly, to maintain the bag in that condition.

7 Claims, 3 Drawing Sheets

CARRYING BAG

The present invention relates to a carrying bag which is transformable in terms of sizes and forms.

BACKGROUND OF THE INVENTION

A carrying bag is convenient for use if it can be converted into different sizes and forms for carrying objects of different sizes and shapes according to the day-to-day need of a user. Although there are already transformable multi-size bags on the market, they are designed for travelling purpose only. Transformability for day-to-day carrying bags, particularly in a simple and easy manner, has been an oversight.

The invention seeks to provide a carrying bag that can easily be transformed from one size/form to another.

SUMMARY OF THE INVENTION

According to the invention, there is provided a carrying bag comprising a flexible body having a top opening and left and right sides, and co-operable fasteners provided along the length of the peripheries of the left and right sides respectively, said left and right sides being foldable towards each other for transforming the bag into a narrower condition having a correspondingly smaller top opening, with the fasteners engaging to maintain the bag in that condition.

Preferably, the left and right sides are foldable close together for the respective fasteners to engage directly with each other.

In a specific construction, the carrying bag includes an internal part having opposite sides provided with respective fasteners for engagement with respective fasteners of the left and right sides, with said fasteners of the left and right sides engaging indirectly with each other via the internal part.

More specifically, the body is formed by a pair of body panels, and the internal part may be provided by an intermediate part of the or one of the panels.

It is preferred that the body is formed by a pair of body panels.

In a preferred embodiment, the fasteners are provided to extend internally along the length of the peripheries of the left and right sides for engagement, with the left and right sides foldable inwards.

More preferably, the body is flippable inside-out to expose the fasteners for engagement, with the left and right sides foldable across.

In another preferred embodiment, the fasteners are provided to extend externally along the length of the peripheries of the left and right sides for engagement, with the left and right sides foldable across.

In a preferred construction, the body includes carrying means provided at a position within combined second and third quarter sections of the body taken in the direction across the left and right body sides.

More preferably, the carrying means is elongate and flexible and connected to the top opening of the body.

It is preferred that the body includes a stiffening member which extends across the combined second and third quarter sections of the body, for aiding the folding of left and right body sides.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
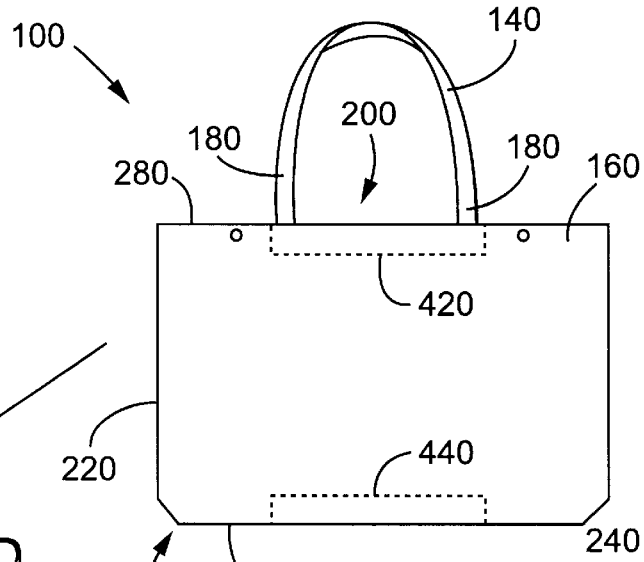
FIGS. 1 to 4 are various views of an embodiment of a carrying bag in accordance with the invention, showing how the bag is transformed into a first different size/form.

Referring firstly to FIGS. 1 to 4 of the drawings, there is shown a carrying bag 100 embodying the invention, which bag 100 has a normally flat body 120 and a pair of flexible straps 140. The body 120 is formed by two generally rectangular flexible panels 160 which are sewed together along their left and right shorter sides 220 and 240 as well as along their lower longer sides 260 to form a bottom, with a top opening 200 being formed along their upper longer sides 280. Each of the straps 140 is sewed at its two ends 180 to the upper side 280 of the respective panel 160, such that the two straps 140 lie side-by-side when the body 120 is in a flat condition.

The straps 140 are intended to be used for a user to carry the bag 100 by his shoulder or hand. More specifically, the two ends 180 of each strap 140 are sewed to the upper side 280 of the respective panel 160 at positions falling just within opposite ends of combined second and third quarter sections of the panel 160 taken in the direction across the left side 220 and the right side 240. The combined second and third quarter sections of each panel 160 is reinforced, at the top and bottom, by means of a pair of stiffening tapes 420 and 440 extending there across. The main use of the tapes 420 and 440 is to aid the folding of the left and right body sides 220 and 240.

The bag 100 includes, internal, a pair of co-operable open-ended zipper fasteners 320 and 340, each of which is sewed to or between the panels 160 along the periphery of respective left or right sides 220 or 240. The zipper fasteners 320 and 340 extend along substantially the entire length of the panel left and right sides 220 and 240, respectively.

Figure 2:
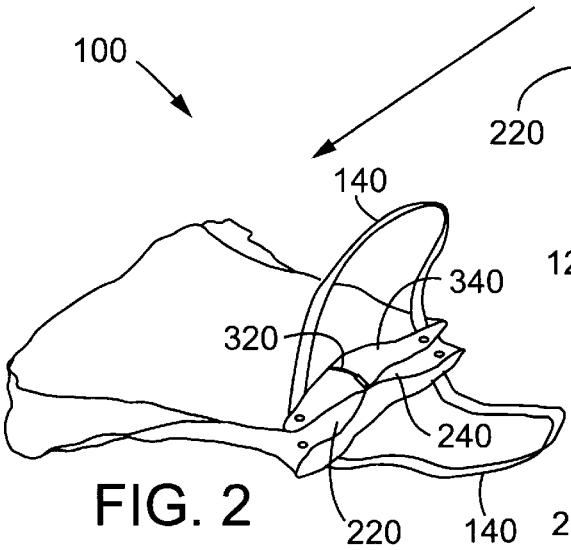
Figure 3:
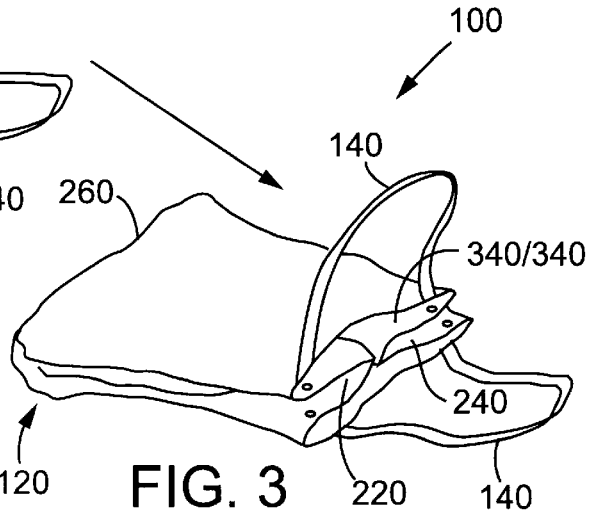
Figure 4:
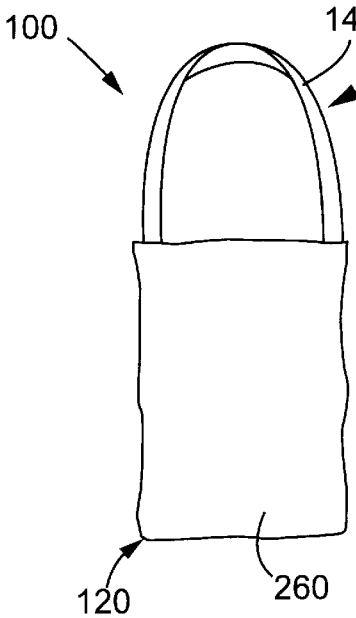

The bag 100 is transformable from a normal, relatively larger size and horizontal rectangular form (FIG. 1) into a relatively smaller size (narrower) and upright rectangular form (FIG. 4). For such transformation, the left and right sides 220 and 240 of the body 120 are initially pressed or folded inwards until the respective zipper fasteners 320 and 340 meet each other inside (FIG. 2). The two body sides 220 and 240 are finally zipped together, from top to bottom, through inter-engagement between the zipper fasteners 320 and 340 internally (FIG. 3). The bag 100 is thus transformed into a condition which is not only smaller in size, with a correspondingly smaller top opening 200, but also provides a pair of half-sized upright rectangular compartments lying side-by-side for better organisation of the objects to be carried inside, all having individual top openings.

Figure 5:
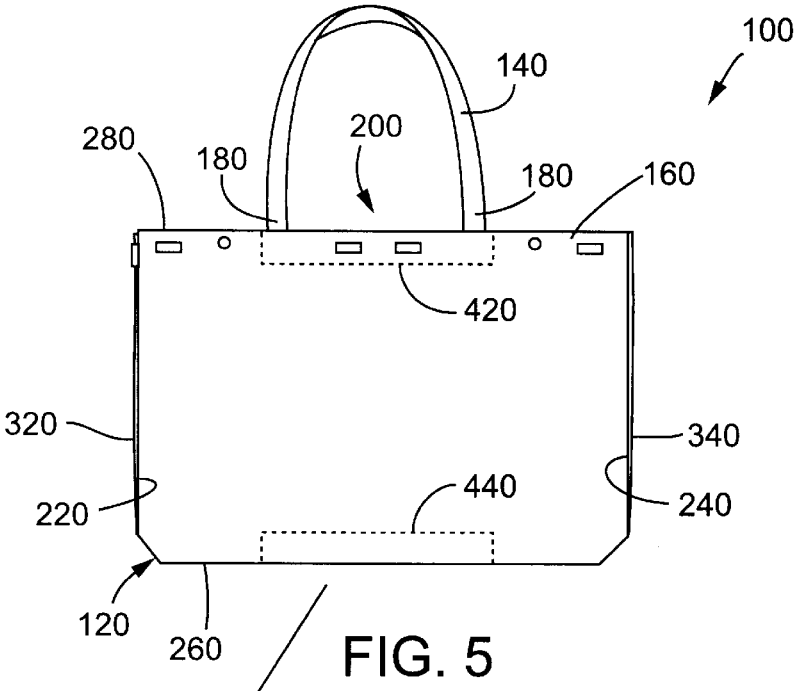
FIGS. 5 to 7 are various views of the bag of FIG. 1, showing how the bag is transformed into a second different size/form.
Figure 6:
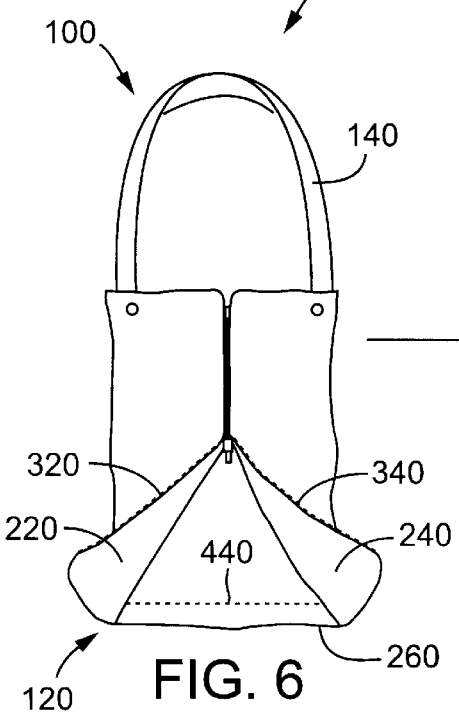
Figure 7:
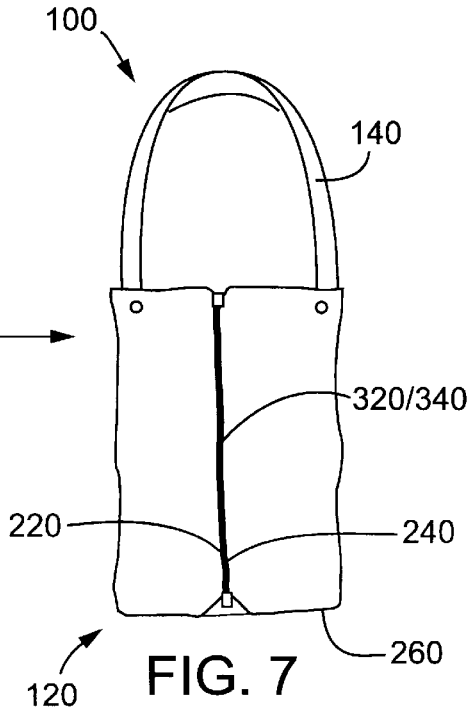

Reference is also made to FIGS. 5 to 7 of the drawings, which show how the bag 100 is transformed from the normal, relatively larger size and horizontal rectangular form (FIG. 5) into another relatively smaller size and upright rectangular form (FIG. 7). For such transformation, the body 120 is initially flipped inside-out to expose the zipper fasteners 320 and 340. The left and right body sides 220 and 240 of the body 120 are then folded across until the respective zipper fasteners 320 and 340 meet each other outside (FIG. 6). The two body sides 220 and 240 are finally zipped together, from top to bottom, through inter-engagement between the fasteners 320 and 340 externally (FIG. 6). The bag 100 is thus transformed into a condition which is not only smaller in size, with a correspondingly smaller top opening 200, but also provides a half-sized upright rectangular compartment and a pair of quarter-sized upright rectangular compartments lying side-by-side with each other and with the half-sized compartment, all having individual top openings.

For this transformation, the internal finishing of the bag 100 should be made as good as its external finishing for use inside-out. Different colour and/or textual designs may be applied to the internal and external finishings for additional changes. If intended, the zipper fasteners 320 and 340 may be provided both internally and externally along the peripheries of the body sides 220 and 240 such that the bag 100 may be converted into the second transformed condition without flipping inside-out.

In either transformed condition (FIG. 4 or 7), the straps 140, or any other alternative carrying means such as a handle, will not be affected because they are provided within the combined second and third quarter sections of the bag 100, and maintained by the stiffening tapes 420 and 440. The tapes 420 and 440 also serve to aid the folding of the left and right body sides 220 and 240, about the tapes' opposite ends.

Figure 9:
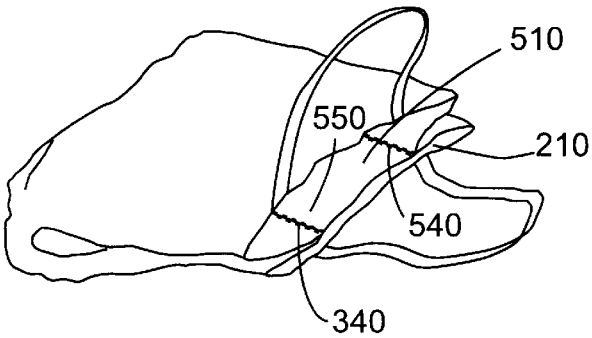
FIGS. 8 and 9 are, respectively, views of a panel that may be used with the bag and the bag including the panel.
Figure 8:
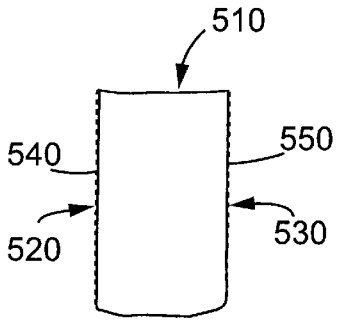

The carrying bag 100 may be supplied with a separate panel 510 shown in FIG. 8 which is rectangular and has opposite, left and right sides 520 and 530 provided with a pair of open-ended zipper fasteners 540 and 550. The panel is sufficiently small for use inside the bag 100, with its zipper fasteners engaging with respective fasteners 320 and 340 of the bag 100, while the bag's left or right sides 220 or 240 are folded inwards as shown in FIG. 9. This panel is useful for transforming the bag 100 into a narrower condition which is, however, wider than the half-size condition described above. While in use, the panel also acts as a partition.

Figure 10:
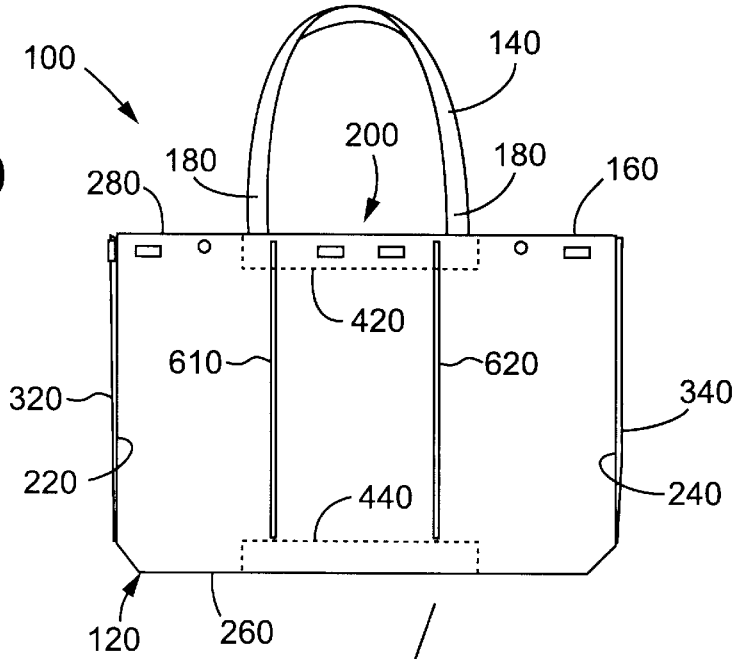
FIGS. 10 and 11 are views of an alternative embodiment of the bag showing how the bag is transformed into a third different size/form.
Figure 11:
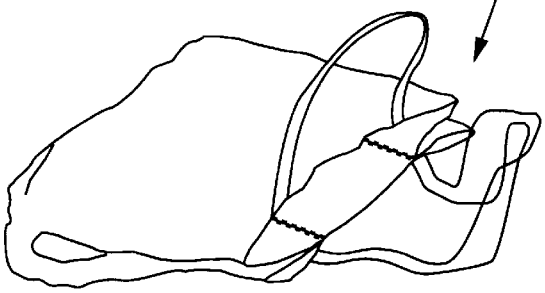

In a slightly different embodiment shown in FIGS. 10 and 11, an intermediate part of one (or both) of the body panels 160 is stitched with a pair of vertical, horizontally spaced apart open-ended zipper fasteners 610 and 620. These fasteners are provided for engaging with respective fasteners 320 and 340 of the bag 100, while the bag's left or right sides 220 or 240 are folded inwards as shown in FIG. 11. Such an intermediate part with zipper fasteners is used for bag transformation in essentially the same manner as the separate panel 510 with zipper fastener.

Accordingly, the bag fasteners 320 and 340 may engage either directly with each other or indirectly via a bridging member or part for maintaining the bag 100 in a transformed condition.

It is envisaged that any other forms of fasteners 320 and 340 may be used instead, such as loop-and-hook fastening tapes, button closure or press-studs.

By reason of its transformability, the bag 100 will satisfy different needs in terms of carrying volume and carrying habits. As this unique design only involves the use of simple fastening means, the transformation can be done effortlessly and quickly without calling for any complicated instructions.

The invention has been given by way of example only, and various other modifications of and/or alterations to the described embodiment may be made by persons skilled in the art without departing from the scope of the invention as specified in the appended claims.

What is claimed is:

1. A carrying bag comprising a flexible body having a top opening and left and right sides, and co-operable fasteners extending internally along peripheries of the left and right sides, respectively, for engagement, when the left and right sides are folded inwardly, the left and right sides being foldable towards each other for transforming the bag into a narrower condition having a correspondingly smaller top opening, with the fasteners engaging to maintain the bag in that condition, wherein the body is reversible, inside-out, by passing the flexible body through the top opening with the co-operable fasteners respectively engaged along the left and right sides of the flexible body, exposing the fasteners, with the left and right sides folded.

2. A carrying bag comprising a flexible body having a top opening and left and right sides, and co-operable fasteners along peripheries of the left and right sides, respectively, the left and right sides being foldable towards each other for transforming the bag into a narrower condition having correspondingly smaller top opening, with the fasteners engaging to maintain the bag in that condition, and further including an internal part having opposite sides that are provided with respective fasteners for engagement with respective ones of the co-operable fasteners along the peripheries of the left and right sides, with the fasteners of the left and right sides engaging indirectly with each other via the internal part.

3. A carrying bag as claimed in claim 2, wherein the body is formed by a pair of body panels, and the internal part is provided by an intermediate part of the of the panels.

4. The carrying bag as claimed in claim 2 wherein the body is formed by a pair of body panels, and the internal part is provided by one of the panels.

5. A carrying bag comprising a flexible body having a top opening and left and right sides, and co-operable fasteners along peripheries of the left and right sides, respectively, the left and right sides being foldable towards each other for transforming the bag into a narrower condition having a correspondingly smaller top opening and direct engagement of the respective fasteners with each other, the fasteners engaging to maintain the bag in that condition, and including an internal part having opposite sides that are provided with respective fasteners for engagement with respective fasteners on the left and right sides, with the fasteners on the left and right sides engaging indirectly with each other via the internal part.

6. The carrying bag as claimed in claim 5, wherein the body is formed by a pair of body panels, and the internal part is provided by an intermediate part of one of the panels.

7. The carrying bag as claimed in claim 5, wherein the body is formed by a pair of body panels, and the internal part is provided by one of the panels.

* * * * *